US005759066A

United States Patent [19]

Okabe

[11] Patent Number: 5,759,066

[45] Date of Patent: Jun. 2, 1998

[54] PRESS-CONNECTING CONNECTOR WITH INTEGRAL COVER

[75] Inventor: Toshiaki Okabe, Shizuoka, Japan

[73] Assignee: Yazaki Corporation, Tokyo, Japan

[21] Appl. No.: 647,041

[22] Filed: May 9, 1996

[30] Foreign Application Priority Data

May 12, 1995 [JP] Japan ..... 7-114746

[51] Int. Cl.[6] ..... H01R 13/516

[52] U.S. Cl. ..... 439/598; 439/682

[58] Field of Search ..... 439/598, 599, 439/682, 686, 695, 687, 701

[56] References Cited

U.S. PATENT DOCUMENTS

| | | | |
|---|---|---|---|
| 4,721,478 | 1/1988 | Sonobe | 439/598 |
| 5,100,345 | 3/1992 | Endo et al. | 439/598 |
| 5,145,411 | 9/1992 | Pastal et al. | 439/598 |

FOREIGN PATENT DOCUMENTS 62-200252 12/1987 Japan .

*Primary Examiner*—Hien Vu

*Attorney, Agent, or Firm*—Sughrue, Mion, Zinn, Macpeak & Seas, PLLC

[57] ABSTRACT

A press-connecting connector with an integral cover, in which the production cost can be reduced by reducing the number of steps in a connector housing-molding process, and an automatic assembling process can be simplified by a relatively simple mechanical operation. A press-connecting connector 11 of the invention comprises a housing body 16 having terminal receiving chambers 14 which respectively receive press-connecting terminals 13, and having respective open sides 15, and a tubular housing cover 17 fitted on an outer periphery of the housing body 16 to cover the open sides of the terminal receiving chambers 14. Connecting piece portions 18 are molded integrally with the connector, and interconnect the housing body 16 and the housing cover 17. When the housing body 16 and the housing cover 17 are to be completely fitted together, the connecting piece portions 18 are cut off, and the housing body 16 is further pushed into the housing cover 17, thereby completing the assembly of the press-connecting connector.

4 Claims, 4 Drawing Sheets

PRESS-CONNECTING CONNECTOR WITH INTEGRAL COVER

BACKGROUND OF THE INVENTION

1. Field of the Invention

This invention relates to a press-connecting connector with an integral cover, in which a housing body, having a plurality of terminal receiving chambers (each having an open side) respectively receiving press-connecting terminals, and a housing cover are molded integrally with each other.

2. Description of the Related Art

A conventional press-connecting connector, used for connecting a wire harness mounted in a vehicle such as an automobile, is disclosed in Japanese Utility Model Unexamined Publication No. 62-200252.

As shown in FIG. 6, the press-connecting connector comprises a housing body A, a housing cover B, and a plurality of press-connecting terminals C received in the housing body A.

The housing body A is injection molded of a resin, and has an integral construction, and comprises a pair of housing units A1 and A2 interconnected by a connecting band 1 serving as a hinge. Each of the housing units A1 and A2 has a row of terminal receiving chambers 2*a*, 2*b* (having an open top) for receiving the respective press-connecting terminals C. The housing units A1 and A2 are joined together by the connecting band 1 in such a manner that the open sides of the terminal receiving chambers 2*a* and 2*b* are directed upwardly when the housing body A is open.

The housing cover B is injection molded of a resin, and has an integral construction, and includes a partition plate 3 which is held between the housing units A1 and A2, stacked together with the connecting band 1 bent, to cover the open sides of the terminal receiving chambers 2*a* and 2*b*, and connecting portions 6 which are integrally formed respectively on opposite side edges of the partition plate 3, each of the connecting portions 6 having an engagement groove 5 engageable with retaining projections 4 formed on outer surfaces of the housing units A1 and A2.

The press-connecting terminal C of an integral construction is formed by bending a metal sheet, and includes a terminal fitting portion 7 for receiving a mating press-connecting terminal, a pair of press-connecting blades 8 which cut a sheath of a sheathed wire W (see FIG. 8) in order to be electrically connected to a conductor of the sheathed wire when the sheathed wire is forced between the press-connecting blades 8, wire holding piece portions 9 for holding the sheathed wire W press-connected to the press-connecting blades 8, and a bending portion 10 for bending the sheathed wire W to prevent rearward withdrawal of the sheathed wire W.

In the press-connecting connector of the above construction, the press-connecting terminals C are mounted respectively in the terminal receiving chambers 2*a* and 2*b* of the housing units A1 and A2 when the same are held in an open condition shown in FIG. 6, and the sheathed wires W are press-connected to the press-connecting terminals C, respectively. Then, the housing units A1 and A2 are closed together, with the partition plate 3 of the housing cover B held therebetween. As shown in FIGS. 7 and 8, the retaining projections 4, formed on the outer surfaces of the housing units A1 and A2, are engaged in the associated engagement grooves 5 of the housing cover B, thus completing the assembly of the press-connecting connector.

In the press-connecting connector of FIGS. 6 to 8, the housing body A and the housing cover B must be molded separately from each other, and this inevitably increases the molding steps, so that the production cost is increased.

Although the component parts can be supplied by a part feeder or the like, the pivotal movement of the housing units A1 and A2 about the connecting band 1 (serving as the hinge) in the opening and closing direction, as well as the mounting of the housing cover B (i.e., the separate member) between the housing units A1 and A2, can not be easily effected automatically by a machine.

Also, when the housing units A1 and A2 are closed together, the bent or curved portion of the connecting band 1 is projected from the side of the housing body A, and it is possible that this projected portion will become caught during the transfer on an automatic assembling line, thus causing improper transfer. Therefore, structural improvement is necessary.

SUMMARY OF THE INVENTION

It is therefore an object of this invention to overcome the above problems, and more specifically to provide a press-connecting connector with an integral cover, in which the production cost can be reduced by reducing the number of steps of a connector housing-molding process, and an automatic assembling process can be simplified by a relatively simple mechanical operation.

The above objects of the invention have been achieved by a press-connecting connector with an integral cover comprising a housing body which has a predetermined number of terminal receiving chambers respectively receiving press-connecting terminals, and is open to an outer periphery of the housing body; and a housing cover fitted on the outer periphery of the housing body to cover open sides of the housing body; characterized in that the housing body and the housing cover are molded integrally with each other through connecting piece portions which are cut off when the housing cover is to be completely fitted on the housing body.

Preferably, retaining projections for withdrawal-preventing purposes are formed respectively on opposite side walls of the housing body, and are formed integrally with the connecting piece portions, respectively.

Therefore, the number of the component parts is small, and the number of molds to be used, as well as the number of steps of the molding process, is reduced.

When the housing body is fitted to the housing cover (which are molded integrally with each other) together, the connecting piece portions, interconnecting them, are cut off, and the housing body and the housing cover are linearly moved relatively to each other so as to push the housing body into the housing cover, and thus the assembly of the press-connecting connector can be easily completed by a simple mechanical operation.

There is no hinge portion projecting outwardly from the connector housing, and therefore there is little chance that such portion will become caught during the transfer on a part feed line, and therefore no improper transfer will occur.

DESCRIPTION OF THE PREFERRED EMBODIMENT

Figure 1:
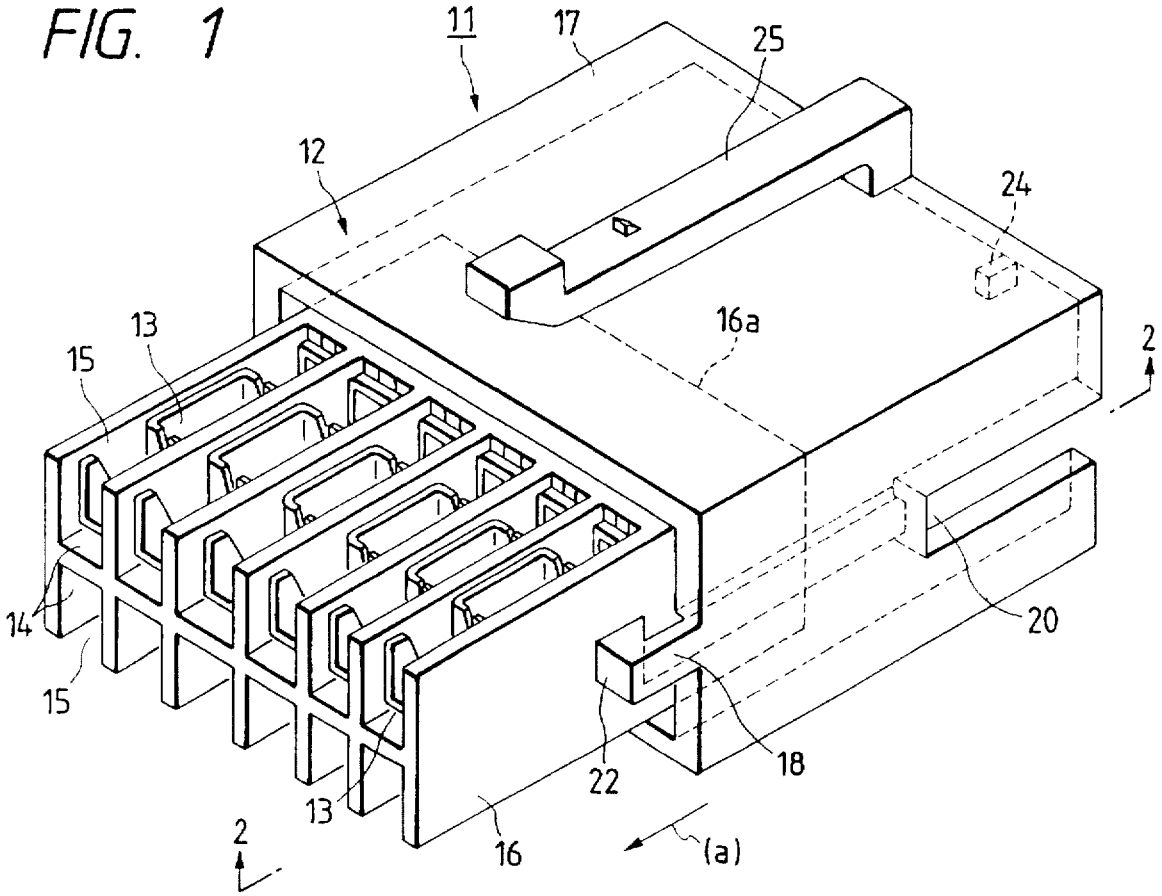
FIG. 1 is a perspective view of a preferred embodiment of a press-connecting connector of the invention with an integral cover, showing a condition before a housing body and a housing cover are completely fitted together.

One preferred embodiment of a press-connecting connector of the invention with an integral cover will now be described in detailed with reference to FIGS. 1 to 5. As shown in FIG. 1, the press-connecting connector 11 of this embodiment comprises a connector housing 12 which is integrally constructed of an injection molded resin, and press-connecting terminals 13 received and held in the connector housing 12, each of the press-connecting terminals 13 being formed by bending a metal sheet.

The connector housing 12 includes a housing body 16 in which a predetermined number of terminal receiving chambers 14, which respectively receive the press-connecting terminals 13, are formed in such a manner that open sides 15 of these chambers 14 are directed to an outer periphery of the housing body 16. The connector housing 12 also includes a tubular housing cover 17 of a rectangular cross-section which is fitted on the housing body 16 from a front side of the housing body 16 (as indicated by arrow a) so as to cover the open sides 15. The connecting piece portions 18 interconnect the housing body 16 and the housing cover 17 in such a manner that a front end 16*a* of the housing body 16 is received in the housing cover 17. Therefore, the connector housing 12 has an integrally-molded construction in which the housing body 16 is formed integrally with the housing cover 17 through the connecting piece portions 18.

Retaining projections 22 are formed respectively on those portions of opposite side walls of the housing body 16 which are disposed outwardly of the housing cover 17 when the housing body 16 is pushed into the housing cover 17. The retaining projections 22 are engaged respectively in retaining grooves 20 formed in the housing cover 17, thereby preventing rearward withdrawal of the housing body 16. The connecting piece portion 18, extending rearwardly from a rear edge of the housing cover 17, is integrally connected to a distal end of each of the retaining projections 22.

Figure 2:
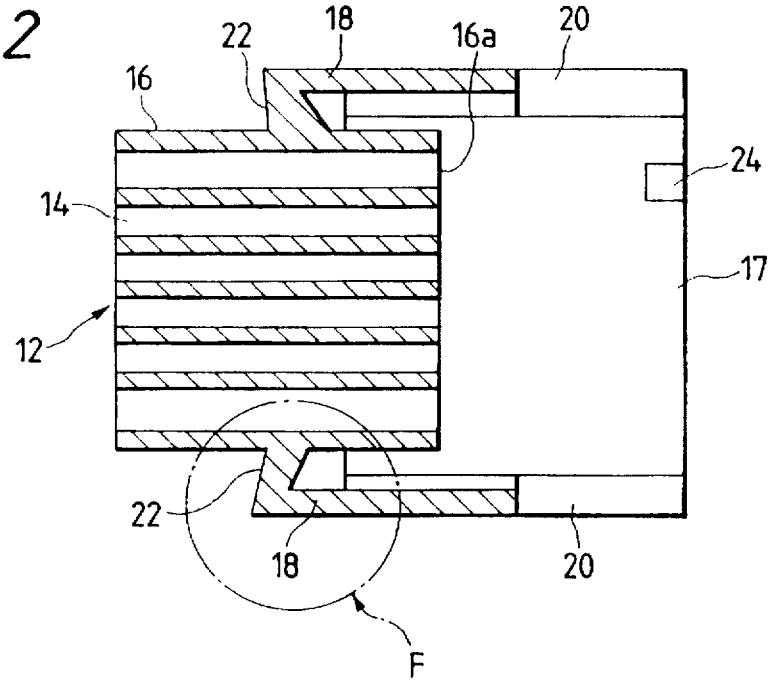
FIG. 2 is a cross-sectional view taken along the line 2—2 of FIG. 1, showing an integrally-molded construction of a connector housing.

As shown in FIGS. 1 and 2, a stopper 24 is formed on an inner surface of the housing cover 17 at the front end portion thereof, and when the housing body 16 is pushed into the housing cover 17, the housing body 16 abuts at its front end against the stopper 24, and therefore is prevented from passing forwardly through the housing cover 17.

An elastic retaining arm 25 is formed on the outer surface of the housing cover 17, and when the press-connecting connector 11 is fitted into a mating connector 26 (see FIG. 4), the elastic retaining arm 25 holds the press-connecting connector 11 against movement relative to the mating connector 26.

Figure 5:
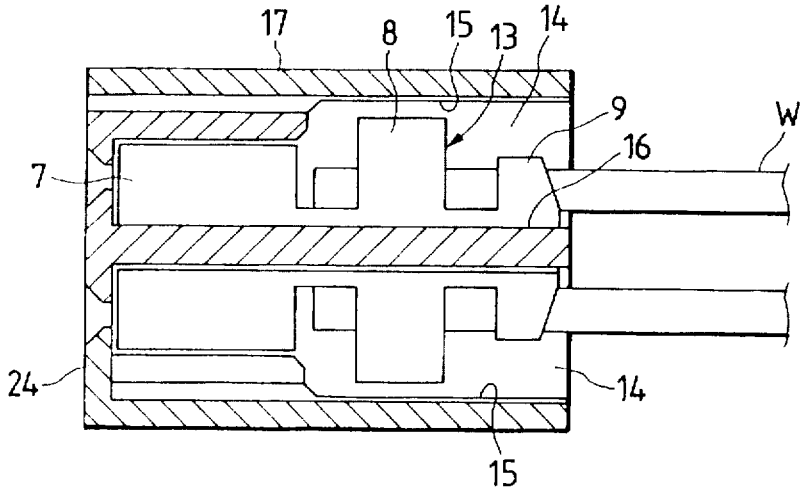
FIG. 5 is a cross-sectional view taken along the line 5—5 of FIG. 4.
Figure 7:
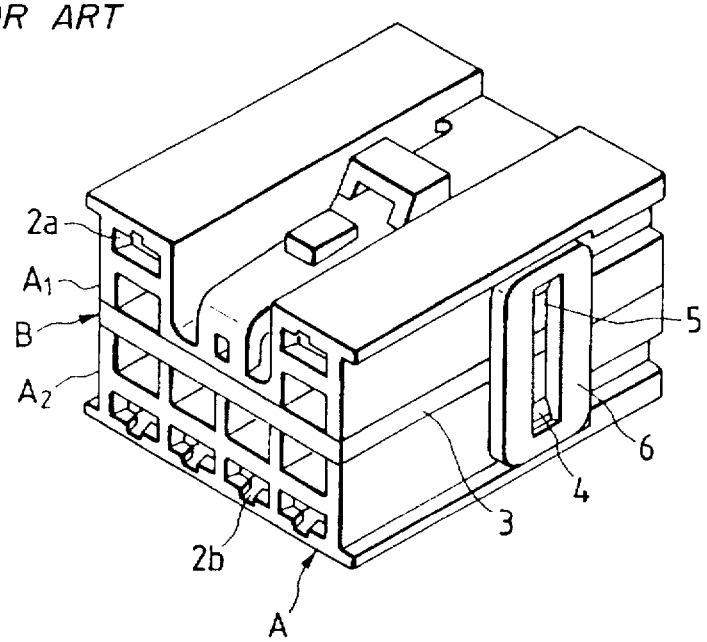
FIG. 7 PRIOR ART
FIG. 7 is a perspective view of the conventional press-connecting connector in its assembled condition.
Figure 8:
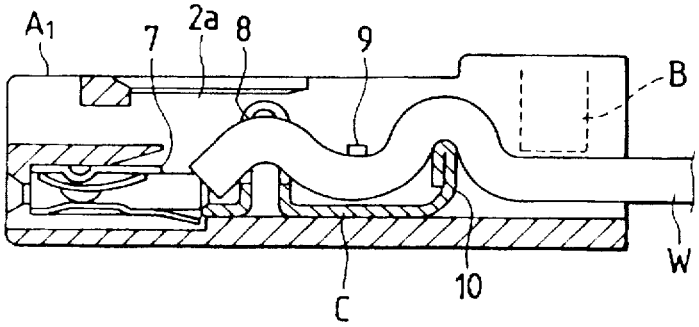
FIG. 8 PRIOR ART
FIG. 8 is a cross-sectional view taken along the line 8—8 of FIG. 6.
Figure 6:
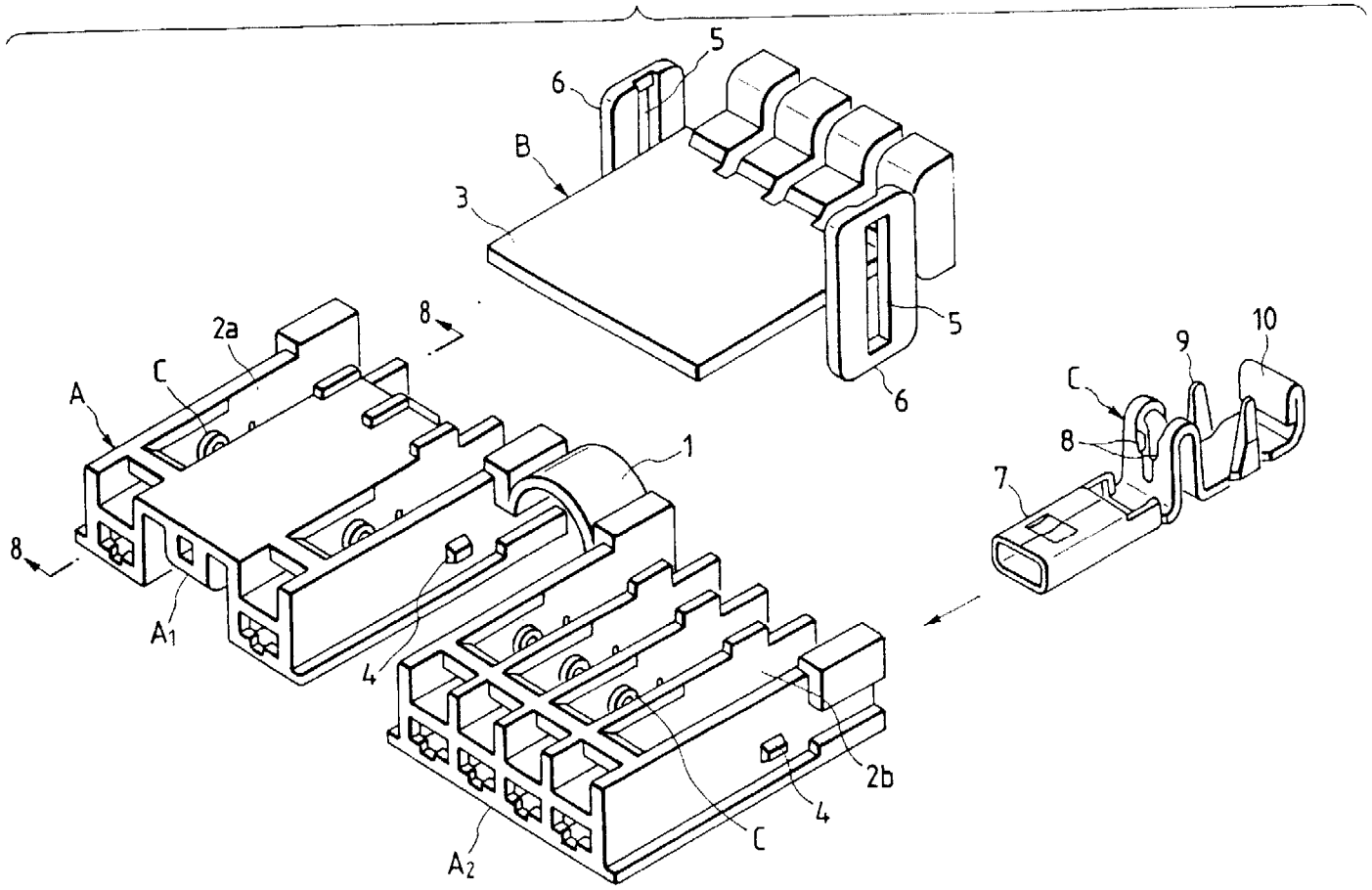
FIG. 6 PRIOR ART
FIG. 6 is an exploded, perspective view of a conventional press-connecting connector.

The press-connecting terminals 13 may have a construction as shown in FIG. 5. The terminal 13 includes a terminal fitting portion 7 for receiving a mating press-connecting terminal, a press-connecting blade 8 which cuts a sheath of a sheathed wire W in order to be electrically connected to a conductor of the sheathed wire when the sheathed wire is press-fitted into the press-connecting blade 8, and wire holding piece portions 9 for holding the sheathed wire W.

Figure 3:
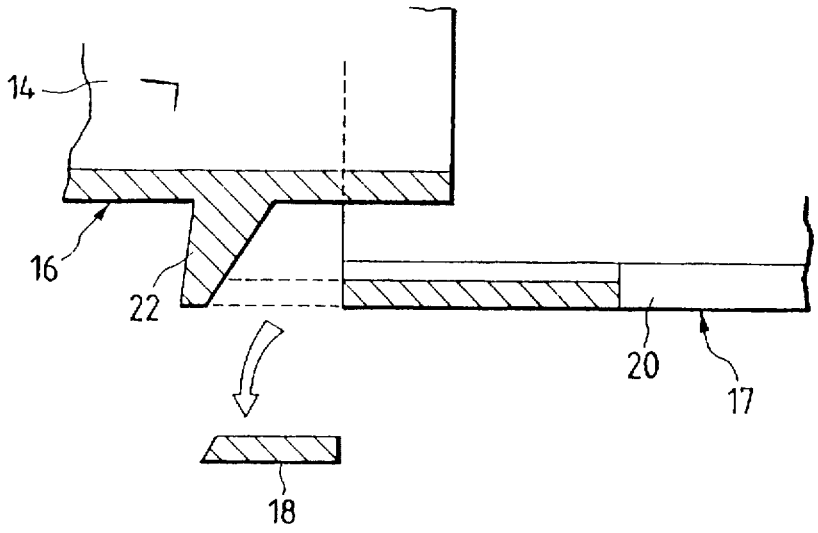
FIG. 3 is a view showing the manner of cutting off a connecting piece portion in the connector housing of FIG. 1.

In the connector housing 12 of the above construction, after the press-connecting terminals are mounted respectively in the terminal receiving chambers 14 in the housing body 16, the connecting piece portions 18 are cut off as shown in FIG. 3, and the housing body 16 is pushed a predetermined amount to be further inserted into the housing cover 17. As a result, the retaining projections 22 are engaged respectively in the retaining grooves 20 in the housing cover 17, thereby preventing the rearward withdrawal of the housing body 16, and also the housing body 16 is abutted at its front end against the stopper 24, and therefore is prevented from further forward movement.

Figure 4:
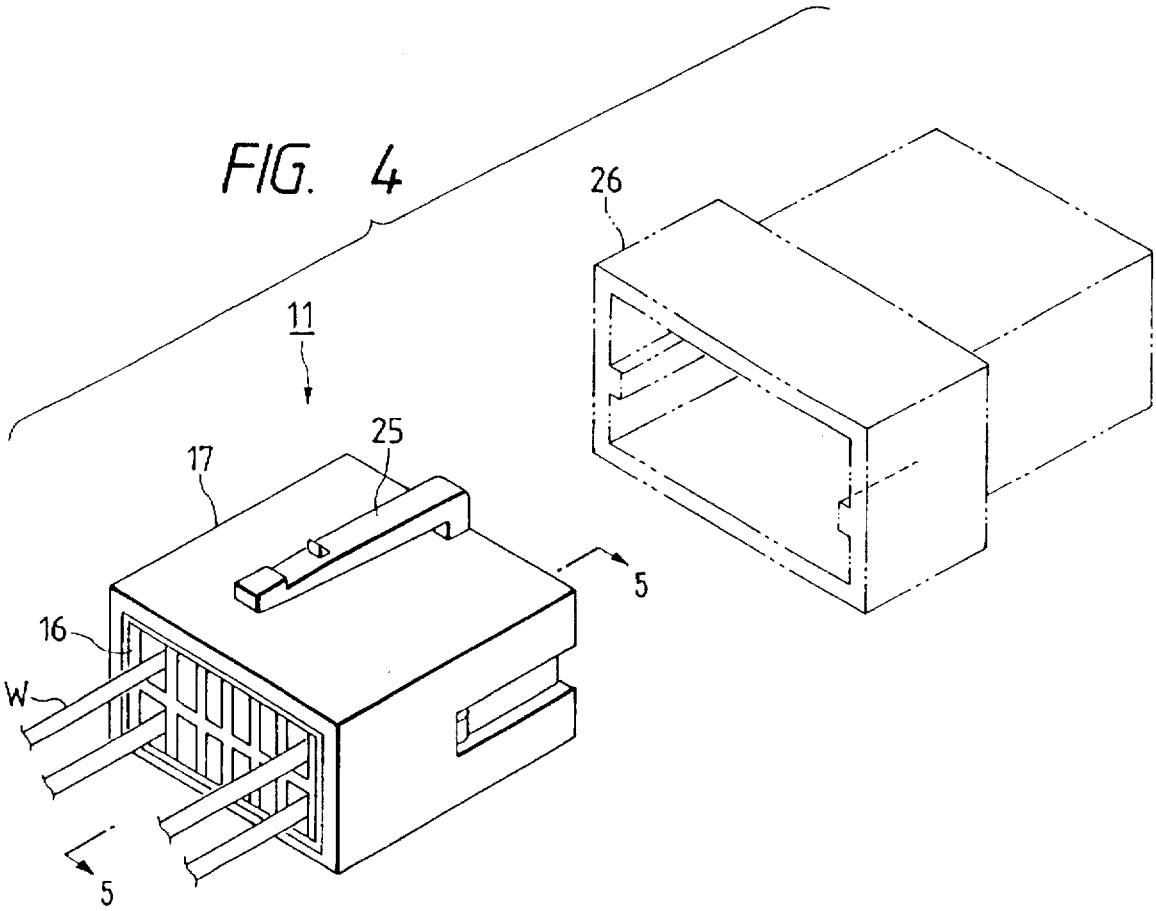
FIG. 4 is a perspective view showing a completely-assembled condition of the press-connecting connector of FIG. 1.

Therefore, the open sides 15 of the terminal receiving chambers 14 are covered by the peripheral wall of the housing cover 17 as shown in FIGS. 4 and 5, thus completing the assembly of the press-connecting connector.

As described above, the press-connecting connector of this embodiment is integrally molded in such a manner that the housing body 16 and the housing cover 17 are formed integrally with each other, and therefore the number of the component parts is small, and the number of molds to be used, as well as the number of steps of the process of molding the connector housing 12, is reduced, so that the production cost can be reduced.

The connecting piece portions 18, through which the housing body 16 and the housing cover 17 are integrally connected together, are cut off, and then the housing body 16 is pushed into the housing cover 17. Therefore, by linearly pushing the housing body 16 and the housing cover 17 relative to each other, the assembling process of the press-connecting connector 11 can be completed, and therefore the press-connecting connector can be assembled by a simple mechanical operation.

There is no hinge portion projecting outwardly from the connector housing, and therefore there is little chance that such portion will become caught by another part or machine during the transfer on an automatic assembling line, and therefore improper transfer will not occur.

Therefore, the automatic assembling of the press-connecting connector can be effected easily, and production efficiency can be greatly improved.

As described above, in the press-connecting connector of the invention with the integral cover, the housing body and the housing cover are molded integrally with each other through the connecting piece portions which are cut off when the housing cover is to be completely fitted on the housing body. The retaining projections for withdrawal-preventing purposes are formed respectively on the opposite side walls of the housing body, and are formed integrally with the connecting piece portions, respectively.

Thus, the housing body and the housing cover are molded integrally with each other, and therefore the number of molds to be used, as well as the number of steps of the molding process, is reduced, so that the production cost can be greatly reduced.

The connecting piece portions, interconnecting the housing body and the housing cover molded integrally with each other, are cut off, and then the housing body is pushed into the housing cover. Thus, the housing body and the housing cover are linearly moved relatively to each other, and therefore the assembly of the press-connecting connector can be reliably completed by such a simple mechanical operation without the occurrence of an improper transfer.

The above-described preferred embodiment is provided for the purposes of illustration and explanation. Many variations in form and detail may be made to the preferred embodiment without varying from the spirit and scope of the invention as defined below.

What is claimed is:

1. An electrical press-connecting connector with an integral cover comprising:

a housing body which has a predetermined number of terminal receiving chambers for respectively receiving press-connecting terminals, said terminal receiving chambers having open sides directed towards an outer periphery of said housing body; and a housing cover, fittable on the outer periphery of said housing body, for covering the open sides of said terminal receiving chambers, wherein said housing body and said housing cover are molded integrally with each other as a single unit through connecting piece portions with said housing cover partially fitted on said outer periphery of said housing body, said connecting piece portions being removable and said housing body being fittable inside said housing cover to completely cover said open sides of said terminal receiving chambers, whereby the assembly of said press-connecting connector can be reliably completed by a simple mechanical operation without the occurrence of an improper transfer.

2. An electrical press-connecting connector with an integral cover according to claim 1, further comprising retaining projections for preventing rearward withdrawal of said housing body from said housing cover, said retaining projections disposed respectively on opposite side walls of said housing body, and formed integrally with said connecting piece portions, respectively.

3. An electrical press-connecting connector according to claim 2, further comprising retaining grooves disposed in said housing cover for receiving said retaining projections.

4. An electrical press-connecting connector according to claim 1, wherein said housing cover comprises a stopper for abutting against said housing body when said housing cover is completely fitted on said housing body to prevent said housing body from passing through said housing cover.

* * * * *